US007655371B2

(12) United States Patent
Wu et al.

(10) Patent No.: US 7,655,371 B2
(45) Date of Patent: Feb. 2, 2010

(54) PHOTOCONDUCTIVE IMAGING MEMBERS

(75) Inventors: Jin Wu, Webster, NY (US); Liang-bih Lin, Rochester, NY (US); Geoffrey M. T. Foley, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 616 days.

(21) Appl. No.: 11/138,433

(22) Filed: May 27, 2005

(65) Prior Publication Data

US 2006/0269856 A1 Nov. 30, 2006

(51) Int. Cl.
*G03G 5/047* (2006.01)

(52) U.S. Cl. ..... 430/59.5; 430/59.4; 430/62; 430/63; 430/124; 399/159

(58) Field of Classification Search ..... 430/59.4, 430/62, 63, 124, 59.5; 399/159
See application file for complete search history.

(56) References Cited

U.S. PATENT DOCUMENTS

| | | | | |
|---|---|---|---|---|
| 3,121,006 | A | | 2/1964 | Middleton et al. |
| 4,265,990 | A | | 5/1981 | Stolka et al. |
| 4,286,033 | A | | 8/1981 | Neyhart et al. |
| 4,291,110 | A | | 9/1981 | Lee |
| 4,298,697 | A | | 11/1981 | Baczek et al. |
| 4,338,387 | A | | 7/1982 | Hewitt |
| 4,338,390 | A | | 7/1982 | Lu |
| 4,560,635 | A | | 12/1985 | Hoffend et al. |
| 4,587,189 | A | | 5/1986 | Hor et al. |
| 4,654,284 | A | | 3/1987 | Yu et al. |
| 4,921,769 | A | | 5/1990 | Yuh et al. |
| 5,225,551 | A | * | 7/1993 | Duff et al. ..... 540/141 |
| 5,238,764 | A | * | 8/1993 | Molaire et al. ..... 430/59.5 |
| 5,523,189 | A | * | 6/1996 | Molaire ..... 430/59.5 |
| 5,932,385 | A | * | 8/1999 | Takamura et al. ..... 430/63 |
| 6,156,468 | A | | 12/2000 | Wehelie et al. |
| 6,177,219 | B1 | | 1/2001 | Yuh et al. |
| 6,255,027 | B1 | | 7/2001 | Wehelie et al. |
| 6,492,080 | B1 | * | 12/2002 | Burt et al. ..... 430/59.4 |
| 2006/0057480 | A1 | * | 3/2006 | Lin et al. ..... 430/65 |
| 2006/0105254 | A1 | * | 5/2006 | Wu et al. ..... 430/59.5 |

FOREIGN PATENT DOCUMENTS

| | | | |
|---|---|---|---|
| GB | 2322866 | * | 9/1998 |

OTHER PUBLICATIONS

Diamond, "Handbook of Imaging Materials," Marcel Dekker, Inc. NY, NY, 1991.*
U.S. Appl. No. 10/992,500, filed Nov. 18, 2004.
U.S. Appl. No. 10/942,277, filed Sep. 16, 2004.

* cited by examiner

*Primary Examiner*—Mark F Huff
*Assistant Examiner*—Peter L Vajda
(74) *Attorney, Agent, or Firm*—Oliff & Berridge, PLC

(57) ABSTRACT

A photoconductive imaging member including at least a substrate, an optional thick undercoat layer, a charge generating layer comprising a high sensitivity pigment and a low sensitivity pigment, and a charge transport layer.

18 Claims, No Drawings

PHOTOCONDUCTIVE IMAGING MEMBERS

BACKGROUND

Described herein are imaging members, and more specifically, multi-layered photoconductive imaging members comprised of a substrate, an optional conductive layer, an optional undercoat layer, an optional adhesive layer, a charge generating layer, a charge transport layer, and an optional overcoat layer.

Layered photoconductive imaging members have been described in numerous U.S. patents, such as U.S. Pat. No. 4,265,990, the disclosure of which is totally incorporated herein by reference, wherein there is illustrated an imaging member comprised of a charge generating layer, and an aryl amine hole transport layer. Examples of charge generating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

In U.S. Pat. No. 4,587,189, the disclosure of which is totally incorporated herein by reference, there is illustrated a layered imaging member with, for example a perylene, pigment charge generating component. Other components, such as the charge generating compounds and the aryl amine charge transport material, can be selected for the imaging members in various embodiments.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM®, available from OxyChem Company.

Sensitivity is a very important electrical characteristic of photoconductive imaging members or photoreceptors. Sensitivity may be described in two aspects. The first aspect of sensitivity is spectral sensitivity, which refers to sensitivity as a function of wavelength. An increase in spectral sensitivity implies an appearance of sensitivity at a wavelength in which previously no sensitivity was detected. The second aspect of sensitivity, broadband sensitivity, is a change of sensitivity (e.g., an increase) at a particular wavelength previously exhibiting sensitivity, or a general increase of sensitivity encompassing all wavelengths previously exhibiting sensitivity. This second aspect of sensitivity may also be described as change of sensitivity, encompassing all wavelengths, with a broadband (white) light exposure. A common problem encountered in the manufacturing of photoreceptors is maintaining consistent spectral and broadband sensitivity from batch to batch.

To satisfy these demands, photoreceptors with different charge generating layer formulations providing varying photosensitivities may be utilized. Charge generating layers are often formed by layering a dispersion of photoconductive pigments on to the photoreceptor. The cost to develop different photoconductive pigments and different charge generating layer coating dispersion formulations and to change dispersion solutions for different products in the manufacturing process greatly increases the costs to manufacture photoreceptors.

Thus, it is desirable that the electrical characteristics of photoreceptors be consistent during the manufacturing process, while keeping the cost of manufacture low. Further, it is desirable to permit printing with a minimum number of photoconductive passes.

SUMMARY

In embodiments, described is a photoconductive imaging member comprising, a substrate, a charge generating layer comprising a high sensitivity pigment and a low sensitivity pigment, and a charge transport layer. Due to the charge generating layer having a high sensitivity pigment and a low sensitivity pigment, the photoconductive imaging member exhibits a sensitivity between about −150 and about −650 $Vcm^2/erg$ (with a 30 μm charge transport layer). The photoconductive imaging member can further include a conductive layer, a thick undercoat layer, an adhesive layer and/or an overcoat layer.

The photoconductive imaging member can be used in known xerographic and electrophotograpic imaging processes.

DETAILED DESCRIPTION OF EMBODIMENTS

The present disclosure relates to photoconductive imaging devices having a high sensitivity. The photoconductive imaging devices are generally multilayered photoreceptors that comprise a substrate, an optional conductive layer, an optional undercoat layer, an optional adhesive layer, a charge generating layer, a charge transport layer, and an optional overcoat layer. The charge generating layer comprises at least one high sensitivity pigment, such as one disclosed in copending U.S. patent application Ser. No. 10/992,500, filed Nov. 18, 2004, which is incorporated herein in its entirety by reference. The charge generating layer further comprises at least one low sensitivity pigment.

Illustrative examples of substrate layers selected for the imaging members of the present invention, and which substrates may be know substrates and which can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example, a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on a number of factors, including the characteristics desired and economical considerations, thus this layer may be of substantial thickness, for example over 3,000 microns, such as from about 3,000 to about 7,000 or of minimum thickness, such as at least about 50 microns, providing there are no significant adverse effects on the member. In embodiments, the thickness of this layer is from about 75 microns to about 300 microns.

If a conductive layer is used, it is positioned over the substrate. The term "over" as used herein in connection with many different types of layers, should be understood as not being limited to instances where the layers are contiguous. Rather, the term refers to relative placement of the layers and encompasses the inclusion of unspecified intermediate layers.

Suitable materials for the conductive layer include, but are not limited to, aluminum, zirconium, niobium, tantalum, vanadium, hafnium, titanium, nickel, stainless steel, chromium, tungsten, molybdenum, copper, and the like, and mixtures and alloys thereof.

The thickness of the conductive layer is, in one embodiment, between about 20 angstroms and about 750 angstroms, and, in another from about 50 angstroms to about 200 angstroms for an optimum combination of electrical conductivity, flexibility, and light transmission. However, the conductive layer can, if desired, be opaque.

The conductive layer can be applied by known coating techniques, such as solution coating, vapor deposition, and sputtering. In embodiments, an electrically conductive layer is applied by vacuum deposition. Other suitable methods can also be used.

If an undercoat layer is employed, it is preferably positioned over the substrate, but under the charge generating layer. The undercoat layer is at times referred to as a hole-blocking layer in the art.

Suitable undercoat layers for use herein include, but are not limited to, polymers, such as polyvinyl butyral, epoxy resins, polyesters, polysiloxanes, polyamides, polyurethanes, and the like, nitrogen-containing siloxanes or nitrogen-containing titanium compounds, such as trimethoxysilyl propyl ethylene diamine, N-beta (aminoethyl) gamma-aminopropyl trimethoxy silane, isopropyl 4-aminobenzene sulfonyl titanate, di (dodecylbenezene sulfonyl) titanate, isopropyl di (4-aminobenzoyl) isostearoyl titanate, isopropyl tri (N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. No. 4,338,387, U.S. Pat. No. 4,286,033 and U.S. Pat. No. 4,291,110.

Preferably, if an undercoat layer is employed, the undercoat layer is a thick undercoat layer as disclosed in co-pending U.S. patent application Ser. No. 10/942,277, filed Sep. 16, 2004, which is incorporated herein in its entirety by reference. Preferably, the undercoat layer comprises a metallic component and a binder component.

Preferably, the metallic component is titanium dioxide or titanium oxide, and the binder component is a phenolic resin, polyester, polyvinyl butyrals, polycarbonates, polystyrene-b-polyvinyl pyridine or polyvinyl formal. The metallic component is preferably present in the undercoat layer in an amount from about 20 to about 95 weight percent of the undercoat layer. The volume resistivity of the metallic oxide is preferably between about $10^4$ to about $10^{10}$ Ω·cm under a pressure of 100 kg/cm$^2$ at ambient conditions. If present, the undercoat layer preferably has a thickness from about 1 micron to about 30 microns.

The undercoat layer may be applied as a coating by any suitable conventional technique such as spraying, die coating, dip coating, draw bar coating, gravure coating, silk screening, air knife coating, reverse roll coating, vacuum deposition, chemical treatment and the like. For convenience in obtaining layers, the undercoat layers are preferably applied in the form of a dilute solution, with the solvent being removed after deposition of the coating by conventional techniques such as by vacuum, heating and the like. Drying of the deposited coating may be effected by any suitable conventional technique such as oven drying, infrared radiation drying, air drying and the like.

If an undercoat containing micron-size particles is employed, formation of interference patterns known as plywood is reduced. The expression "plywood" refers to the formation of unwanted patterns in electrostatic latent images caused by multiple reflections during exposure of a charged imaging member. These patterns resemble plywood.

In fabricating a photosensitive imaging member, a charge generating layer is deposited and a charge transport layer may be deposited onto the substrate surface either in a laminate type configuration where the charge generating layer and charge transport layer are in different layers or in a single layer configuration where the charge generating layer and charge transport layer are in the same layer along with a binder resin. Photoreceptors in accordance with the present disclosure can be prepared by applying the charge generating layer and a charge transport layer. In embodiments, the charge generating layer and the charge transport layer may be applied in any order.

The charge generating layer is positioned over the undercoat layer. If an undercoat layer is not used, the charge generating layer is positioned over the substrate. Preferably, the charge generating layer is comprised of a high sensitivity pigment such as a high sensitivity titanyl phthalocyanine pigment (a Type V titanyl phthalocyanine pigment) which is fully described in U.S. patent application Ser. No. 10/992,500.

For purposes herein, high sensitivity pigments refer to pigments having a sensitivity where the absolute value is equal to or greater than about 500 Vcm$^2$/erg (with a 30 μm charge transport layer). Low sensitivity pigments refer to pigments having a sensitivity where the absolute value is less than about 500 Vcm$^2$/erg (with a 30 μm charge transport layer).

The charge generating layer may further comprise a low sensitivity pigment such as chlorogallium phthalocyanine (Type A, B and C), metal-free phthalocyanine, hydroxygallium phthalocyanine (V), titanyl phthalocyanine (I, II, III and IV), alkoxygallium phthalocyanine and other phthalocyanine pigments, benzylimidizo perylene, crystalline selenium and its alloys; Group II-VI compounds; and organic pigments and dyes such as quinacridones, polycyclic pigments such as dibromo anthanthrone pigments, perylene and perinone diamines, polynuclear aromatic quinones, azo pigments including bis-, tris- and tetrakis-azos; quinoline pigments, indigo pigments, thioindigo pigments, bisbenzimidazole pigments, quinacridone pigments, lake pigments, azo lake pigments, oxazine pigments, dioxazine pigments, triphenylmethane pigments, azulenium dyes, squalium dyes, pyrylium dyes, triallylmethane dyes, xanthene dyes, thiazine dyes, cyanine dyes, and the like.

The ratio of high sensitivity pigment to low sensitivity pigment can range from about 99.9:0.1 to about 0.1:99.9; preferably the ratio is from about 90:10 to about 10:90. This ratio depends on the desired electrical characteristics of the photoconductive imaging members. For example, it is desired to have primarily high sensitivity pigment when photoconductive image members rotating at high speeds are used. By having a charge generating layer of both a high sensitivity pigment and a low sensitivity pigment allows the members to be used in a greater range of devices, i.e., when the used photoconductive imaging members are rotated at speeds ranging from low speed to high speed.

The preferred high sensitivity pigments and optional low sensitivity pigments may be dispersed in a suitable resin binder. In embodiments, the high sensitivity pigment and low sensitivity pigment are present in an amount of from about 20 to 80 weight percent of the charge generating layer.

Any suitable polymeric film-forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

A photogenerating composition or pigment may be present in the resinous binder composition in various amounts. Generally, however, from about 5 percent by volume to about 90 percent by volume of the photogenerating pigment is dispersed in about 10 percent by volume to about 95 percent by volume of the resinous binder, and typically from about 20 percent by volume to about 30 percent by volume of the photogenerating pigment is dispersed in about 70 percent by volume to about 80 percent by volume of the resinous binder composition. The photogenerator layers can also fabricated by vacuum sublimation in which case there is no binder.

In embodiments, a charge transport layer may be employed. The charge transport layer may comprise a charge-transporting molecule, typically small molecule, dissolved or molecularly dispersed in a film forming electrically inert polymer such as a polycarbonate. The term "dissolved" is defined herein as forming a solution in which the molecules are dissolved in the polymer to form a homogeneous phase. The expression "molecularly dispersed" used herein is defined as a charge transporting small molecule dispersed in the polymer, the small molecules being dispersed in the polymer on a molecular scale.

Any suitable charge transporting or electrically active small molecule may be employed in the charge transport layer of this disclosure. The expression charge transporting "small molecule" is defined herein as a monomer that allows the free charge photogenerated in the generator layer to be transported across the transport layer.

Typical charge transporting molecules include, but are not limited to, pyrene, carbazole, hydrazone, oxazole, oxadiazole, pyrazoline, arylanine, arylmethane, benzidine, thiazole, stilbene and butadiene compounds; pyrazolines such as 1-phenyl-3-(4'-diethylaminostyryl)-5-(4'-diethylamino phenyl)pyrazoline; diamines such as N,N'-diphenyl-N,N'-bis(3-methylphenyl)-(1,1'-biphenyl)-4,4'-diamine; hydrazones such as N-phenyl-N-methyl-3-(9-ethyl)carbazyl hydrazone and 4-diethyl amino benzaldehyde-1,2-diphenyl hydrazone; oxadiazoles such as 2,5-bis (4-N,N'-diethylaminophenyl)-1,2,4-oxadiazole; poly-N-vinylcarbazole, poly-N-vinylcarbazole halide, polyvinyl pyrene, polyvinylanthracene, polyvinylacridine, a pyrene-formaldehyde resin, an ethylcarbazole-formaldehyde resin, a triphenylmethane polymer and polysilane, and the like.

In embodiments, to avoid cycle-up in machines with high throughput, the charge transport layer may be substantially free (less than about two percent) of triphenyl methane. As indicated above, suitable electrically active small molecule charge transporting compounds are dissolved or molecularly dispersed in electrically inactive polymeric film forming materials.

An exemplary small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1 '-biphenyl)-4,4'-diamine. If desired, the charge transport material in the charge transport layer may comprise a polymeric charge transport material or a combination of a small molecule charge transport material and a polymeric charge transport material.

In embodiments, the charge transport layer may contain an active aromatic diamine molecule, which enables charge transport, dissolved or molecularly dispersed in a film forming binder. An examplary charge transport layer is disclosed in U.S. Pat. No. 4,265,990, the entire disclosure of which is incorporated herein by reference.

Any suitable electrically inactive resin binder that is also insoluble in the solvent such as alcoholic solvent used to apply the optional overcoat layer may be employed in the charge transport layer. Typical inactive resin binders include polycarbonate resin, polyester, polyarylate, polyacrylate, polyether, polysulfone, and the like. Molecular weights can vary, for example, from about 20,000 to about 150,000. Exemplary binders include polycarbonates such as poly (4,4'-isopropylidene-diphenylene)carbonate (also referred to as bisphenol-A-polycarbonate); polycarbonate; poly (4,4'-cyclohexylidinediphenylene) carbonate (referred to as bisphenol-Z polycarbonate); poly (4,4'-isopropylidene-3,3'-dimethyl-diphenyl)carbonate (also referred to as bisphenol-C-polycarbonate); and the like.

Any suitable charge transporting polymer may also be utilized in the charge transporting layer of this disclosure. The charge transporting polymer should be insoluble in the solvent employed to apply the overcoat layer. These electrically active charge transporting polymeric materials should be capable of supporting the injection of photogenerated holes from the charge generation material and be incapable of allowing the transport of these holes there through.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is from about 10 to about 50 micrometers, but thicknesses outside this range can also be used. A hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of a hole transport layer to the charge generator layers is typically maintained from about 2:1 to 200:1 and in some instances as great as 400:1. Typically, a charge transport layer is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

Additionally, adhesive layers can be provided, if necessary, between any of the layers in the photoreceptors to ensure adhesion of any adjacent layers. Alternatively, or in addition, adhesive material can be incorporated into one or both of the respective layers to be adhered. Such optional adhesive layers may have a thickness of about 0.001 micrometer to about 0.2 micrometer. Such an adhesive layer can be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include, but are not limited to, film-forming polymers, such as polyester, DuPont 49,000 (available from E. I. DuPont de Nemours & Co.), Vitel PE-100 (available from Goodyear Tire and Rubber Co.), polyvinyl butyral, polyvinyl pyrrolidone, polyurethane, polymethyl methacrylate, and the like.

Optionally, an overcoat layer may also be utilized to improve resistance to abrasion. In some cases, an anti-curl back coating may be applied to the side opposite the photoreceptor to provide flatness and/or abrasion resistance where a web configuration photoreceptor is fabricated. These overcoating and anti-curl back coating layers are well known in the art and may comprise thermoplastic organic polymers or inorganic polymers that are electrically insulating or slightly semi-conductive. Overcoatings are continuous and commercially have a thickness of less than about 10 micrometers.

Optionally, an anti-curl backing layer may be employer to balance the total forces of the layer or layers on the opposite side of the supporting substrate layer. An example of an anti-curl backing layer is described in U.S. Pat. No. 4,654,284, the entire disclosure of which being incorporated herein by reference. A thickness between about 70 and about 160 micrometers is a satisfactory range for flexible photoreceptors.

The photoconductive imaging members disclosed herein exhibit a sensitivity ranging from about −150 to about −650 $Vcm^2/erg$ (for a 30 μm charge transport layer).

Processes of imaging, especially xerographic imaging, and printing, including digital, are also encompassed herein. More specifically, the photoconductive imaging members can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members of this invention are useful in color xerographic applications, particularly high-speed color copying and printing processes.

The imaging members are preferably sensitive in the wavelength region of, for example, from about 475 to about 950 nanometers, and in particular from about 650 to about 850 nanometers. As such, diode lasers can be selected as the light source.

Also included in the present disclosure are methods of imaging and printing with the photoconductive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same aforementioned sequence with the exception that the exposure step can be accomplished with a laser device or image bar.

The following Examples are submitted to illustrate embodiments of the present disclosure. These Examples are intended to be illustrative only and are not intended to limit the scope of the present invention.

Several photoreceptor devices were prepared to compare the various electrical properties of different photogenerating layers in the photoreceptor devices. In general, the photoreceptor devices comprised an undercoat layer, a charge generating layer, and a charge transport layer. The specific details of the devices are described with reference to the specific examples.

The photoreceptor devices were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltage versus charge density curves.

The scanner was equipped with a scorotron set to a constant voltage charging at various surface potentials. The devices were tested at surface potentials of 500 V and 700 V with the exposure light intensity incrementally increased by means of regulating a series of neutral density filters. The exposure light source was a 780 nanometer light emitting diode. The aluminum drum was rotated at a speed of 55 revolutions per minute to produce a surface speed of 277 millimeters per second or a cycle time of 1.09 seconds.

The xerographic simulation was completed in an environmentally controlled light tight chamber at ambient conditions (40 percent relative humidity and 22° C.). Photoinduced discharge characteristic (PIDC) curves were obtained from the two different pre-exposed surface potentials, and the data was interpolated into PIDC curves at an initial surface potential of 700 V.

The following properties were measured in the various studies. Sensitivity (S) was measured as the initial slope of a photoinduced discharge characteristic (PIDC) curve (in units of ($V\ cm^2/ergs$)), and $V_{depl}$ was linearly extrapolated from the surface potential versus charge density relation of the device and is a measurement of voltage leak during charging. Dark decay ($V_{dd}$) was the lost potential before light exposure. In general, an ideal photoreceptor device should have higher sensitivity (S) while $V_{dd}$ and $V_{depl}$ should be close to zero.

All the devices were coated with a 3-component undercoat layer, varying charge generating layer and 30 μm charge transport layer, respectively. The 3-component undercoat layer was prepared as follows: Zirconium acetylacetonate tributoxide (35.5 parts), γ-aminopropyltriethoxysilane (4.8 parts) and poly (vinyl butyral) BM-S (2.5 parts) were dissolved in n-butanol (52.2 parts). The coating solution was coated via a ring coater, and the layer was pre-heated at 59° C. for 13 minutes, humidified at 58° C. (dew point=54° C.) for 17 minutes, and then dried at 135° C. for 8 minutes. The thickness of the undercoat layer was approximately 1.3 μm.

The charge generating layer dispersions were prepared as described in the following examples, coated on top of 3-component undercoat layer. The thickness of the charge generating layer was approximately 0.2 μm. Subsequently, a 27 μm charge transport layer (CTL) was coated on top of the charge generating layer from a solution of N,N'-diphenyl-N,N-bis(3-methyl phenyl)-1,1'-biphenyl-4,4'-diamine (9.9 grams) and a polycarbonate, PCZ-400 [poly(4,4'-dihydroxy-diphenyl-1-1-cyclohexane, $M_w$=40000)] available from Mitsubishi Gas Chemical Co., Ltd. (12.1 grams), in a mixture of 55 grams of tetrahydrofuran (THF) and 23.5 grams of monochlorobenzene. The CTL was dried at 135 degrees Centigrade for 45 minutes.

EXAMPLE I

Preparation of TiOPc Type V Charge Generating Layer Coating Dispersion

Three grams of Type V titanyl phthalocyanine (TiOPc Type V), 2 grams of poly(vinyl butyral) (BM-S) and 45 grams of n-butyl acetate was Attritor milled with 150 grams of 1.0-1.25 mm Glen Mills glass beads for 2 hours. The resulting dispersion was filtered through a 20 μm Nylon cloth filter, and diluted to 5 weight percent solid before coating.

EXAMPLE II

Preparation of ClGaPc Type B Charge Generating Layer Coating Dispersion

Three grams of chlorogallium phthalocyanine Type B (ClGaPc Type B), 2 grams of poly(vinyl butyral) (BM-S) and 45 grams of n-butyl acetate was Attritor milled with 150 grams of 1.0-1.25 mm Glen Mills glass beads for 2 hours. The resulting dispersion was filtered through a 20 μm Nylon cloth filter, and diluted to 5 weight percent solid before coating.

EXAMPLE III, IV, V and VI

Preparations of TiOPc Type V/ClGaPc Type B Tunable Charge Generating Layer Coating Dispersions Dispersions of EXAMPLE I and II were mixed with certain weight ratios as follows to produce: EXAMPLE III (TiOPc Type V/ClGaPc Type B=80/20), EXAMPLE IV (TiOPc Type V/ClGaPc Type B=60/40), EXAMPLE V (TiOPc Type V/ClGaPc Type B=40/60), and EXAMPLE VI (TiOPc Type V/ClGaPc Type B=20/80).

The results of the various examples is set forth below in Table 1.

TABLE 1

| Device | Charge generating layer | S ($Vcm^2$/erg) | $V_{depl}$ (V) |
|---|---|---|---|
| 1 | Example I | −560 | 5 |
| 2 | Example II | −240 | 20 |
| 3 | Example III | −510 | 10 |
| 4 | Example IV | −440 | 15 |
| 5 | Example V | −360 | 20 |
| 6 | Example VI | −290 | 25 |

A wide range of photosensitivity was achieved by a tunable charge ting layer from TiOPc (V) and ClGaPc (B).

It will be appreciated that various of the above-disclosed and other es and functions, or alternatives thereof, may be desirably combined into many different systems or applications. Also, various presently unforeseen or cipated alternatives, modifications, variations or improvements therein may be quently made by those skilled in the art, and are also intended to be passed by the following claims.

What is claimed is:

1. A photoconductive imaging member comprising:

a substrate;

a charge generating layer comprising at least one high sensitivity pigment and at least one low sensitivity pigment; and a charge transport layer;

wherein the photoconductive imaging member has a sensitivity between about −150 and about −650 $Vcm^2$/erg (as measured with a 30 μm charge transport layer), wherein the high sensitivity pigment is Type V titanyl phthalocyanine, wherein the high sensitivity pigment has a sensitivity with an absolute value greater than or equal to 500 $Vcm^2$/erg, and wherein the low sensitivity pigment has a sensitivity with an absolute value less than 500 $Vcm^2$/erg.

2. The photoconductive imaging member according to claim 1, further comprising one or more of an undercoat layer, a conductive layer, an adhesive layer and an overcoat layer.

3. The photoconductive imaging member according to claim 1, wherein the low sensitivity pigment is chiorogallium phthalocyanine, benzylimidizo perylene, metal-free phthalocyanine, hydroxygallium phthalocyanine, titanyl phthalocyanine (I, II, III, and IV), alkoxygallium phthalocyanine, benzylimidizo perylene, crystalline selenium and its alloys, Group II-VI compounds, quinacridones, dibromo anthanthrone pigments, perylene, perinone dianmies, polynuclear aromatic quinones, bis-, tris- and tetrakis-azos, quinoline pigments, indigo pigments, thioindigo pigments, bisbenzimidazole pigments, quinacridone pigments, lake pigments, azo lake pigments, oxazine pigments, dioxazine pigments, triphenylmethane pigments, azulenium dyes, squalium dyes, pyrylium dyes, triallylmethane dyes, xanthene dyes, thiazine dyes or cyanine dyes.

4. The photoconductive imaging member according to claim 1, wherein the ratio of high sensitivity pigment to low sensitivity pigment ranges from about 99.9:0.1 to about 0.1:99.9.

5. The photoconductive imaging member according to claim 1, wherein the high sensitivity pigment and low sensitivity pigment are dispersed in a binder.

6. The photoconductive imaging member according to claim 5, wherein the high sensitivity pigment and low sensitivity pigment are present in an amount from about 20 to about 80 weight percent and the binder is present in an amount from about 80 weight percent to about 20 weight percent of the charge generating layer.

7. The photoconductive imaging member according to claim 1, wherein the charge generating layer has a thickness from about 0.1 μm to about 5 μm.

8. The photoconductive imaging member according to claim 7, wherein a ratio of the thickness of the charge transport layer to the thickness of the charge generating layer is from about 2:1 to about 200:1.

9. The photoconductive imaging member according to claim 2, wherein the undercoat layer comprises a metallic component and a binder component.

10. The photoconductive imaging member according to claim 9, wherein the metallic component is titanium dioxide or titanium oxide, and the binder component is a phenolic resin, polyester, polyvinyl butyrals, polycarbonates, polystyrene-b- polyvinyl pyridine or polyvinyl formal.

11. The photoconductive imaging member according to claim 9, wherein the metallic component has a volume resistivity of about $10^4$ to about $10^{10}$ Ω·cm under a pressure of 100 kg/cm$^2$ at ambient conditions.

12. The photoconductive imaging member according to claim 2, wherein the undercoat layer has a thickness between about 0.1 μm and about 30 μm.

13. A method comprising:

generating an image on a photoconductive imaging member;

developing the image; and transferring the developed image to a recording substrate;

wherein the photoconductive imaging member comprises a substrate, a charge generating layer comprising a high sensitivity pigment and a low sensitivity pigment, and a charge transport layer, wherein the photoconductive imaging member has a sensitivity between about −150 and about −650 Vcm$^2$/erg (as measured with a 30 μm charge transport layer), wherein the high sensitivity pigment is Type V titanyl phthalocyanine, wherein the high sensitivity pigment has a sensitivity with an absolute value greater than or equal to 500 Vcm$^2$/erg, and wherein the low sensitivity pigment has a sensitivity with an absolute value less than 500 Vcm$^2$/erg.

14. A xerographic device comprising a photoconductive imaging member, wherein the photoconductive imaging member comprises a substrate, a charge generating layer comprising a high sensitivity pigment and a low sensitivity pigment, and a charge transport layer, wherein the photoconductive imaging member has a sensitivity between about −150 and about −650 Vcm$^2$/erg (as measured with a 30 μm charge transport layer), wherein the high sensitivity pigment is Type V titanyl phthalocyanine, wherein the high sensitivity pigment has a sensitivity with an absolute value greater than or equal to 500 Vcm$^{2/}$erg, and wherein the low sensitivity pigment has a sensitivity with an absolute value less than 500 Vcm$^2$/erg.

15. The xerographic device according to claim 14, wherein the low sensitivity pigment is chiorogallium phthalocyanine, benzylimidizo perylene, metal-free plithalocyanine, hydroxygallium phthalocyanine, titanyl phthalocyanine (I, II, III and IV), alkoxygallium phthalocyanine, benzylimidizo perylene, crystalline selenium and its alloys, Group II-VI compounds, quinacridones, dibromo anthanthrone pigments, perylene, perinone diamines, polynuclear aromatic quinones, bis-, tris- and tetrakis-azos, quinoline pigments, indigo pigments, thioindigo pigments, bisbenzimidazole pigments, quinacridone pigments, lake pigments, azo lake pigments, oxazine pigments, dioxazine pigments, triphenylmethane pigments, azulenium dyes, squalium dyes, pyryliuni dyes, triallylmethane dyes, xanthene dyes, thiazine dyes or cyanine dyes.

16. The xerographic device according to claim 14, wherein the ratio of high sensitivity pigment to low sensitivity pigment ranges from about 99.9:0.1 to about 0.1:99.9.

17. The xerographic device according to claim 14, wherein the high sensitivity pigment and low sensitivity pigment are dispersed in a binder.

18. The xerographic device according to claim 17, wherein the high sensitivity pigment and low sensitivity pigment are present in an amount from about 20 to about 80 weight percent and the binder is present in an amount from about 80 weight percent to about 20 weight percent of the charge generating layer.

* * * * *